US008544612B2

(12) United States Patent
Korhonen et al.

(10) Patent No.: US 8,544,612 B2
(45) Date of Patent: Oct. 1, 2013

(54) METHODS AND SYSTEMS FOR PROVIDING SERVICE REQUESTS TO CONVEYANCE SYSTEMS

(75) Inventors: Pekka Korhonen, Espoo (FI); Ilpo Haipus, Nummela (FI)

(73) Assignee: KONE Corporation, Helsinki (FI)

( * ) Notice: Subject to any disclaimer, the term of this patent is extended or adjusted under 35 U.S.C. 154(b) by 0 days.

(21) Appl. No.: 13/544,040

(22) Filed: Jul. 9, 2012

(65) Prior Publication Data

US 2012/0305339 A1 Dec. 6, 2012

Related U.S. Application Data

(63) Continuation of application No. PCT/FI2011/050008, filed on Jan. 7, 2011.

(30) Foreign Application Priority Data

Jan. 7, 2010 (FI) ..... 20100003

(51) Int. Cl.
*B66B 1/18* (2006.01)

(52) U.S. Cl.
USPC ..... 187/387; 187/391

(58) Field of Classification Search
USPC ..... 187/316, 380–388, 391–396; 49/26, 49/28; 318/16, 446, 454; 340/5.2, 5.23, 340/5.27, 5.5, 5.62, 5.7, 5.71, 5.8
See application file for complete search history.

(56) References Cited

U.S. PATENT DOCUMENTS 4,591,854 A 5/1986 Robinson
5,204,672 A 4/1993 Brooks
5,541,585 A * 7/1996 Duhame et al. ..... 340/5.62
5,811,897 A 9/1998 Spaude et al.
6,580,356 B1 6/2003 Alt et al.
6,615,175 B1 * 9/2003 Gazdzinski ..... 704/275
6,707,374 B1 * 3/2004 Zaharia ..... 340/5.31
6,801,792 B1 * 10/2004 Schuster et al. ..... 455/566
6,828,918 B2 * 12/2004 Bowman et al. ..... 340/4.1
6,868,945 B2 * 3/2005 Schuster et al. ..... 187/380

(Continued)

FOREIGN PATENT DOCUMENTS

DE 102005003488 A1 8/2006
EP 0843425 A2 5/1998

(Continued)

OTHER PUBLICATIONS

International Search Report PCT/ISA/210 for International Application No. PCT/FI2011/050008 dated Mar. 8, 2011.

(Continued)

*Primary Examiner* — Anthony Salata
(74) *Attorney, Agent, or Firm* — Harness, Dickey & Pierce, P.L.C.

(57) ABSTRACT

A conveyance system comprises at least one user interface having at least one service request pushbutton for providing service requests to the conveyance system. An identifier device is provided to a passenger. The identifier device stores identifier device data for determining a service profile of the identifier device. The identifier device data in the identifier device is read when a passenger presses or touches a service request pushbutton of the user interface. Based on the data read from the identifier device, the service profile of the identifier device is determined. A service request connected to the service request pushbutton is activated based on the service profile.

15 Claims, 2 Drawing Sheets

(56) References Cited

U.S. PATENT DOCUMENTS

Figure 1:
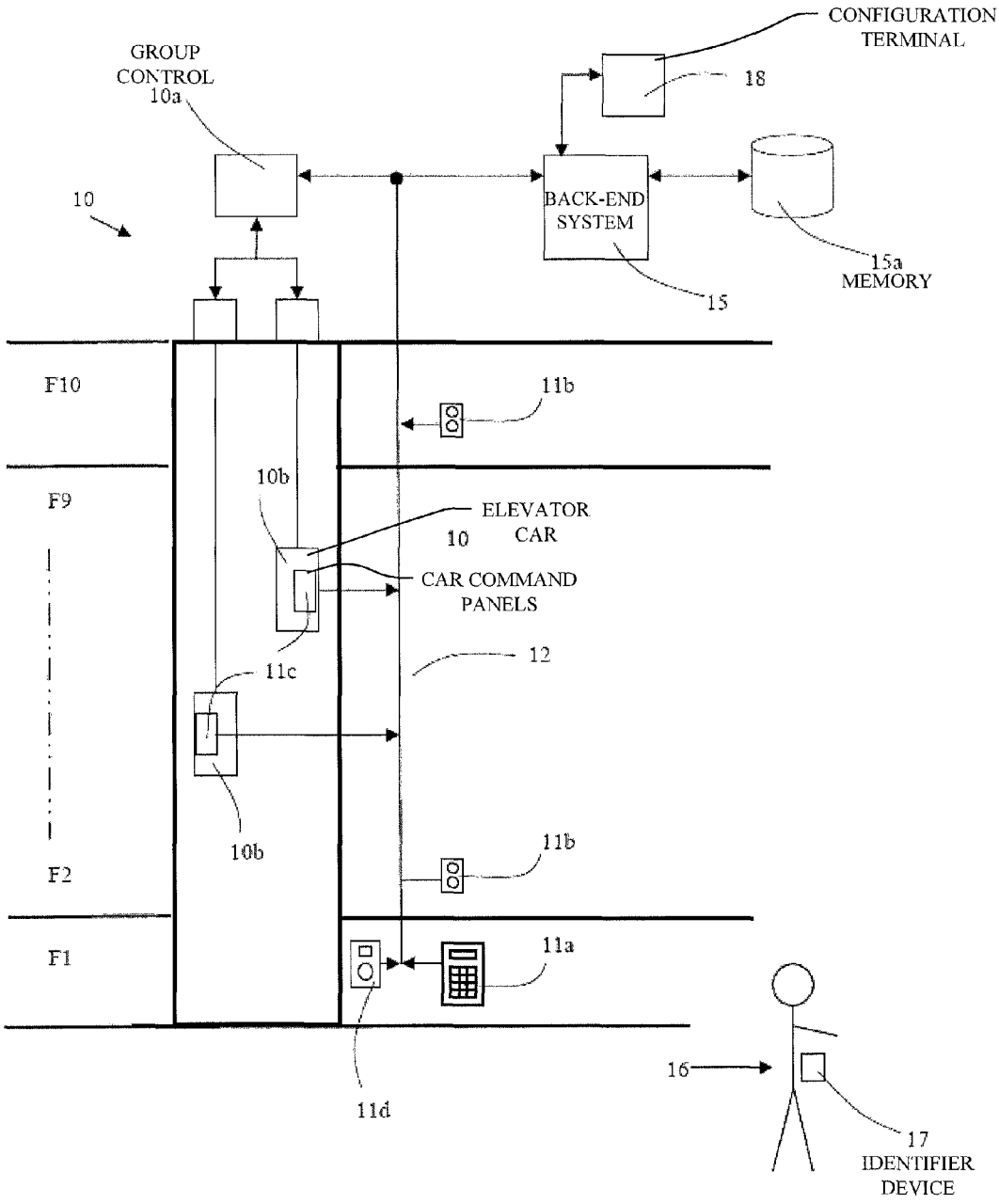

| | | | | |
|---|---|---|---|---|
| 6,986,408 | B2 * | 1/2006 | Takeuchi | 187/380 |
| 7,145,433 | B2 * | 12/2006 | Gerstenkorn | 340/5.22 |
| 7,328,775 | B2 * | 2/2008 | Zaharia et al. | 187/396 |
| 7,353,915 | B2 * | 4/2008 | Zaharia et al. | 187/388 |
| 7,377,364 | B2 * | 5/2008 | Tyni et al. | 187/380 |
| 7,882,938 | B2 * | 2/2011 | Blackaby et al. | 187/388 |
| 2002/0030585 | A1 | 3/2002 | Doi et al. | |
| 2003/0043018 | A1 | 3/2003 | Gerstenkorn | |
| 2003/0080851 | A1 | 5/2003 | Gerstenkorn | |
| 2005/0017841 | A1 | 1/2005 | Doi et al. | |
| 2005/0138385 | A1 | 6/2005 | Friedli et al. | |
| 2007/0145119 | A1 | 6/2007 | Rhelimi | |
| 2010/0171589 | A1 | 7/2010 | Haberli | |
| 2011/0048864 | A1 * | 3/2011 | Gerstenkorn et al. | 187/380 |

FOREIGN PATENT DOCUMENTS

| | | | |
|---|---|---|---|
| EP | 1187375 | A1 | 3/2002 |
| EP | 1676805 | A1 | 7/2006 |
| WO | WO-2008106816 | A2 | 9/2008 |

OTHER PUBLICATIONS

Finnish Patent Office Search Report for Finnish Application No. 20100003 dated Jun. 11, 2010.

* cited by examiner

METHODS AND SYSTEMS FOR PROVIDING SERVICE REQUESTS TO CONVEYANCE SYSTEMS

CROSS-REFERENCE TO RELATED APPLICATIONS

This is a continuation of PCT/FI2011/050008 filed on Jan. 7, 2011 which is an international application claiming priority from FI 20100003 filed on Jan. 7, 2010; the entire contents of each of which are hereby incorporated by reference.

FIELD OF THE INVENTION

The invention relates to conveyance systems. More particularly the invention relates to a method and to a system for giving service requests to an elevator system and other conveyance systems.

BACKGROUND OF THE INVENTION

With regard to elevator systems, known in the art are call-giving systems wherein a passenger gives elevator calls by means of a call device or identifier device in his/her possession, which device is e.g. a passive RFID (Radio Frequency Identifier) or an active terminal, often provided with pushbuttons, in which terminal the unique identifier code of the terminal is recorded. For reading the data of a call device the elevator system must be provided with reader devices, into the operating range of which a passenger must take his/her call device. The reader devices of call devices that are remotely read can be disposed e.g. in elevator lobbies at a distance from the elevators, whereas the reader devices of call devices that are read from close range are often disposed in connection with conventional destination call panels. On the basis of the data received from a call device, the elevator system can generate a personal destination call to the floor desired by the passenger. Solutions are also known in which passengers are identified from a fingerprint or from some other bio-identification instead of the data read from call devices. Often access control is also connected to the aforementioned solutions such that for each passenger a personal service profile is determined for the elevator system or for a special access control system, in which service profile data about those floors to which the passenger has an access permit is recorded.

A number of drawbacks are, however, connected to the prior-art solutions described above. Systems based on bio-identifiers are often complex and expensive because powerful computer apparatus is needed for processing information in them in order to achieve a reliable and fast identification. A crosstalk problem, on the other hand, wherein a call device in the possession of a passenger is simultaneously detected by two or more reader devices e.g. disposed on different floors, is connected to remotely-read devices. This easily leads to the generation of erroneous elevator calls or other service requests. To minimize the crosstalk problem, reader devices must be located in a building with particular care and accuracy, which of course raises costs. Remotely-read call devices can produce useless elevator calls also when a passenger arriving in an elevator lobby does not want to use the elevators but instead calls into an elevator lobby for some other reason. The use of call devices to be read from close range, on the other hand, requires that the passenger takes out his/her call device and takes it close enough to the reader device, which is impractical and slows down arrival at destination. In prior-art solutions the number of different types of service requests is generally limited to one service request or to only a few service requests, e.g. to just giving a destination call to the default floor of the passenger. The problem can be partly solved by providing a call device with selection pushbuttons, by means of which a passenger can make choices between different service requests. Adding selection pushbuttons, however, easily makes a call device large in size and awkward to use.

AIM OF THE INVENTION

The aim of the present invention is to eliminate or at least to alleviate the aforementioned drawbacks that occur in prior-art solutions. The aim of the invention is also to achieve one or more of the following objectives:

- a reliable and user-friendly solution for the giving of service requests,
- to reduce the amount of erroneous or otherwise accidentally given service requests, to improve access control in buildings,
- a solution in which the user interfaces intended for the normal use of conveyance systems can be utilized,
- a solution in which the services of a conveyance system can be used also without a separate call device,
- a solution in which the user interfaces of a conveyance system, and the functions connected to them, can be personified for specific passengers, and
- a solution in which user-specific usage data about different services can be automatically collected.

SUMMARY OF THE INVENTION

One or more embodiments of the invention are characterized by the claims. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the scope of the basic inventive concept in conjunction with other embodiments.

The present invention discloses a method for giving service requests to the conveyance system of a building, which conveyance system comprises at least one user interface, comprising at least one service request pushbutton for giving service requests to the conveyance system. According to the invention, an identifier device is given into the possession of a passenger, in which identifier device data is recorded for determining the service profile connected to the identifier device. The data contained in the identifier device is read when a passenger presses or touches a service request pushbutton of the user interface. On the basis of the data read from the identifier device the service profile of the identifier device is determined, on the basis of which one or more service requests connected to the service request pushbutton are activated. The term "conveyance system" refers in this context to a system that comprises one or more elevators, an elevator group, an escalator, a travelator, an automatic door, an automatic gate and/or an automatic boom. A service request is e.g. an elevator call, a request to open an automatic door or corresponding, a request for guidance, or some other corresponding service request connected to the conveyance system. The term "building" refers to a delimited space in which a conveyance system is disposed, e.g. an office building, a residential building, a passenger ship, a hotel, and a building complex formed by airport terminals. A user interface can be disposed in the elevator lobbies of a building, in elevator cars, at guidance points, in connection with the automatic doors in a building, in a parking hall and in other premises of a building in which passengers that use a conveyance system move about. Transfer technology, in which the body of the passenger functions at least partly as a transmission path of the data to be transmitted, can preferably be used for reading the data contained in identifier devices, in which case the data can be read e.g. from an identifier device in the pocket of a passenger reliably and without a crosstalk problem. Before activation of a service request, the execution right of a passenger for the requested service can be checked from the service profile of the identifier device, e.g. whether the passenger has an access permit to a certain floor or room in the building. For determining a service profile an identifier device comprises a memory, in which the data specifying a service profile is recorded directly and/or the identifier code (ID) of the identifier device is recorded, on the basis of which ID the service profile can be specified indirectly.

The present invention also discloses a system for giving service requests to the conveyance system of a building. The conveyance system comprises at least one user interface, comprising at least one service request pushbutton for giving service requests to the conveyance system. According to the invention, the system comprises at least one identifier device, which is given into the possession of a passenger using a conveyance system, a reader device connected to a service request pushbutton, which reader device is arranged to read the data contained in an identifier device in the possession of a passenger when the passenger presses or touches the aforementioned service request pushbutton. The system further comprises a back-end system, which receives the data read from an identifier device, determines the service profile of the identifier device on the basis of the data, and activates one or more service requests connected to a service request pushbutton on the basis of the aforementioned service profile.

In one embodiment of the invention the user interface and/or the requested service is personified on the basis of the service profile of the identifier device. As a result of the embodiment, passengers can be offered an individual service and the user interfaces can be simplified, because additional pushbuttons, e.g. for physically handicapped people or other special groups, are not necessarily needed in the user interfaces. Also locked functions, the activation of which has conventionally required a key or other special tool, can be implemented without physical locking by permitting sufficient rights for activating locked functions in the service profile of "superusers".

In one embodiment of the invention usage data about the special services used by passengers is recorded on the basis of the service requests given by passengers. As a result of the embodiment, information about the special services used by a passenger, e.g. about chargeable services, is obtained automatically, in which case he/she can be billed according to the actual amount of special services used. A usage limit can be set for the usage amount of special services, after exceeding which limit the use of a special service is prevented. In the embodiment e.g. the maximum amount of usage times of the gym of a hotel can be "loaded" in advance into the identifier device of a passenger, in which case misuse of special services can be reduced and a better and more diversified service than before can be offered to passengers.

With the solution according to the invention numerous advantages are achieved compared to prior-art solutions. The solution according to the invention is simple and easy to integrate into connection with the normal user interfaces of a conveyance system. The data of an identifier device is read only when a passenger touches/presses the service request pushbutton, in which case the giving of erroneous or unintended service requests, which is possible in the case of remotely-read call devices, is avoided. The solution according to the invention is also user-friendly because the identifier device does not need to be taken out for giving a service request, but instead the passenger can keep his/her identifier device e.g. in his/her pocket. The functions of the interface and the services of the conveyance system can also be personified to specific passengers, which facilitates and speeds up the arrival of a passenger at his/her destination. User interfaces can be simplified because neither additional pushbuttons nor physical lockings are needed for special groups. Access control can be integrated into a system according to the invention, in which case a separate access control system is not needed in the building. By monitoring automatically the use of special services the misuse of the services can be reduced and the services to be offered to passengers can be improved.

LIST OF FIGURES

Figure 2:
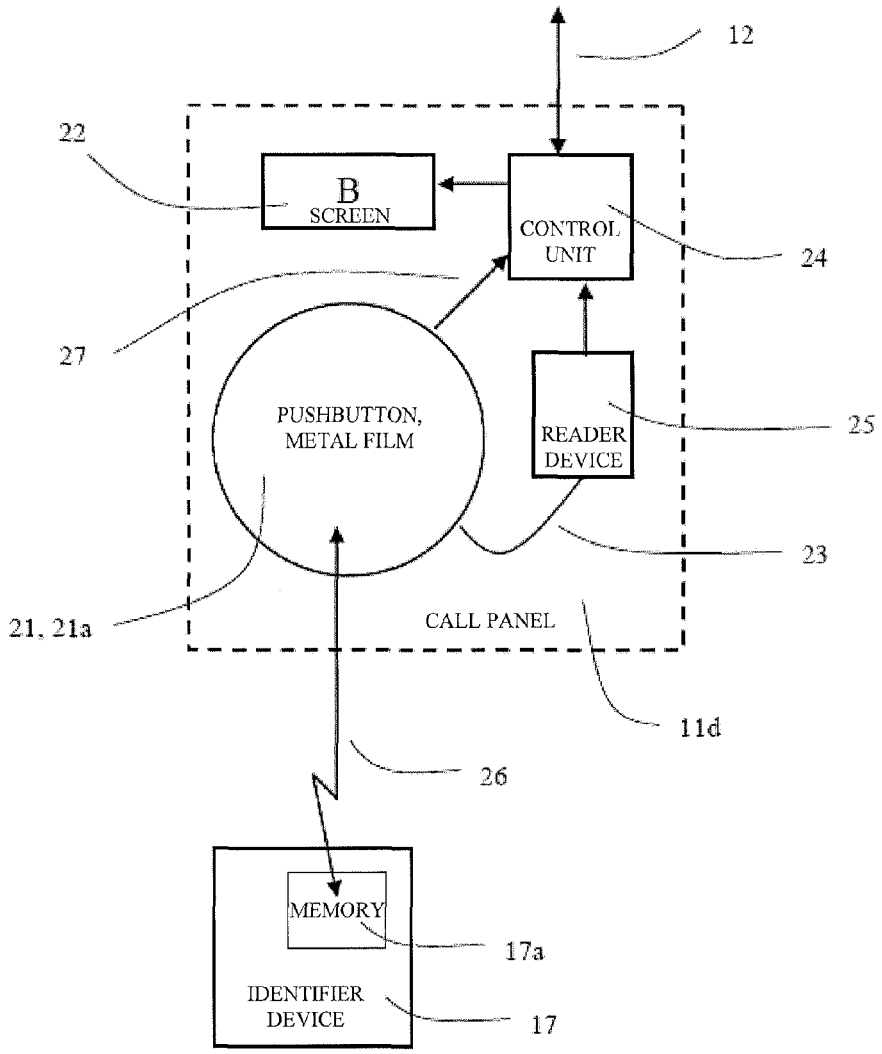

In the following, the invention will be described in detail by the aid of examples of its embodiments, wherein:

FIG. 1 presents one system according to the invention,

FIG. 2 presents one user interface according to the invention.

DETAILED DESCRIPTION OF THE INVENTION

FIG. 1 presents one system according to the invention in a building, wherein an elevator group 10 serves the floors F1-F10 of the building. The elevator group comprises up/call pushbuttons 11*b* on the floors F2-F10 for calling an elevator car 10*b* to a call floor, a destination call panel 11*a* for giving destination calls in the entrance lobby F1, and car command panels 11*c* for giving car commands in the elevator cars 10*b*. In addition, the elevator system comprises a call panel 11*d*, the operation of which is described in more detail later. The call panels 11 (11*a*-11*d*) that function as the user interfaces of an elevator group are connected to a local network 12, via which the back-end system 15, the group control 10*a* and the call panels 11 can transmit data to each other. The local network 12 can be any data transfer network whatsoever that is suited to the purpose, e.g. a CAN-bus (Controller Area Network). The devices to be connected to the local network 12 can be arranged to communicate among themselves also in another manner to what is presented in FIG. 1.

The back-end system 15 comprises a processing unit, application software to be run in the processing unit, and also memory means 15*a*, in which the service profiles of the identifier devices 17 in the possession of passengers are recorded. A service profile determines e.g. the floors for which the holder 16 (passenger) of an identifier device 17 has an access permit, a default floor, on the basis of which an elevator for traveling to a certain floor can be automatically ordered for a passenger, guidance information, information about the personal limitations of a passenger, such as about a physical handicap or visual impairment, up-to-date information about the special services used or in the use of a passenger, et cetera. Also information about the period of validity, within which a passenger can use his/her identifier device, can be connected to a service profile. In addition, a service profile comprises the identifier code, e.g. an individual ID number, of the identifier device, to which it is desired the service profile be connected. The data connected to service profiles is entered and recorded in the memory means 15*a* of the back-end system by the aid of a configuration terminal 18.

For reading the data contained in an identifier device 17, a reader device 21 (presented in FIG. 2) is integrated in connection with the user interfaces 11, which reader device reads the data recorded in the memory means of an identifier device 17 when a passenger presses or touches one of the pushbuttons of the user interface 11. Transfer technology that is per se prior art can be applied to the transmission of data, in which technology the resistive and capacitive properties of the human body are utilized. The transfer technology in question is presented e.g. in publications U.S. Pat. No. 4,591,854 and EP0843425, to which reference is made in this context. For utilizing the aforementioned transfer technology in the present invention the service request pushbuttons of the user interfaces 11 are provided with a contact surface that conducts electricity, which surface is connected to a reader device 21 with cabling suited to the purpose. If the service request pushbutton is a mechanical pushbutton, the contact surface is integrated into the front surface of the pushbutton or if the user interface is based on a touch-sensitive display, the contact surface is integrated into the front surface of the touch-sensitive display such that it covers one or more service request pushbuttons to be presented on the touch-sensitive display. When a passenger presses or touches a service request pushbutton of the user interface, and simultaneously the contact surface integrated into it, the reader device can read the data contained in the identifier device in the possession of the passenger utilizing the resistive and/or capacitive properties of the body. A particular advantage of the solution is that a passenger does not need to take his/her identifier device out but instead it can be e.g. in his/her pocket at the time of giving a service request.

In the system according to FIG. 1 an individual identifier code is recorded in the identifier device 17. The identifier code as well as the data about the service request pushbutton pressed/touched by a passenger is transmitted from the user interface to the back-end system 15, which determines the service profile of the identifier device on the basis of the identifier code and checks from the service profile whether the passenger has the execution right to the service request connected to service request pushbutton, e.g. whether the passenger has an access permit to the destination floor according to the call pushbutton. If the access permit is valid, the back-end system activates the service request by sending a call corresponding to the call pushbutton to the group control of the elevator group; in other cases, the call is rejected. If a passenger does not have an identifier device 17, or the service profile of the identifier device is not found, the back-end system uses a default profile, which permits the use of certain general services intended for all passengers in the conveyance system.

When the service profile of an identifier device is determined, the back-end system can personify the user interface on the basis of the data recorded in the service profile. For example, if the car command panels 11*c* in the elevator car are implemented with touch-sensitive screen technology, the data to be presented in them can be generated with software program(s) and can be personified to specific passengers e.g. such that a passenger is shown the call pushbuttons of only those floors for which he/she has an access right on the basis of the service profile or, if the passenger is visually impaired, texts and other information are presented larger than normally on the touch-sensitive display. Also the conveyance service itself can be personified e.g. such that for the time of a journey made by a visually impaired passenger audible guidance is activated and the open time of the elevator doors on the floor landings is lengthened.

FIG. 2 presents a diagram of the functional parts of a call panel 11*d* that functions as a user interface of an elevator system 10 and also the functional parts of an identifier device 17 that is in the possession of a passenger. The user interface comprises a service request pushbutton 21, which is covered by a metal film 21*a* that functions as a contact surface and that is connected to a reader device 24 with a cable 23. When a passenger presses the pushbutton 21 and at the same time the metal film 21*a*, the reader device 25 reads along the transmission path 26 the data recorded in the memory means 17*a* of the identifier device 17 and transmits the data to the control unit 24 of the user interface 11*d*. The aforementioned data and also the data identifying the pushbutton 21 are sent as a service request to the back-end system 17 via the local network 12. The back-end system sends to the control unit a response connected to the service request, e.g. data about the elevator allocated to the passenger, which response is expressed to the passenger on a screen 22 that is in connection with the user interface.

The pushbutton 21 can be a touch-sensitive button or a conventional pushbutton. Information about the touching or pressing of a pushbutton is transmitted to the control unit 24 (presented with the arrow 27 in FIG. 2). The pushbutton data 27 about the touching/pressing of the pushbutton also enables those passengers who do not have an identifier device 17 to give service requests with the pushbutton 21. The user interface can preferably be extended to comprise a number of pushbuttons 21 by transmitting the pushbutton data 27 from each pushbutton to the control unit 24 and by connecting the contact surfaces 21*a* connected to all the pushbuttons to the same reader device 25.

By providing an identifier device 17 with a memory 17*a* of sufficiently large capacity, the data of the service profile of an identifier device can be recorded in the identifier device itself. As a result of the arrangement, the functions of the back-end system can be distributed, e.g. integrated into the user interfaces 11 and/or into the other devices that are in connection with the system, in which case the centralized back-end system 15 according to FIG. 1 is not needed. In this case decisions about the service requests to be activated are made locally, e.g. in the aforementioned user interfaces and/or in the control units of individual conveyance devices. The arrangement requires that the reader device 25 must also be able to record data in the memory of an identifier device if it is desired to maintain in the service profile usage amount counters or other updatable data about special services.

In the following the invention will be described in the light of some examples.

In the first example, floors F1-F10 of the building of FIG. 1 are divided according to their intended usage such that floors F1-F8 are general floors, to which people can travel freely by elevator, whereas floors F9 and F10 are in commercial use, access to which requires a valid access permit. The arrangement enables the access of casual visitors without an identifier device to floors F1-F8, while people traveling to floors F9 and F10 must have an identifier device 17. An identifier device has been given to a person who works for company X on floor F9, using which device he/she can travel to floor F9 and F10. When the employee arrives in the entrance lobby F1 of the building, he/she moves to the elevators and presses a pushbutton 21 of the call panel 11*d* and an elevator is allocated to him/her for traveling to floor F9 on which his/her workplace is situated. If an employee is not, for some reason, traveling to the default floor F9, he/she can give a destination call to floors F2-F8 using the destination call panel 11*a*. If the employee wants, during his/her workday, to travel from floor F9 to other floors of the building, he/she can order an elevator using the up/down pushbuttons 11*b* and give a call to the floor he/she wants from the car command panel 11*c* of the elevator car. If, in this case, the destination floor given by the employee is F10, the employee is identified in connection with giving the call and it is ensured that he/she has an access permit for floor F10. If the access control of the building requires a higher level of security, an "opening button", which is connected to local bus 12 (not shown in FIG. 1), e.g. of the call panel 11*d* type, can be arranged in connection with the automatic door leading to the entrance lobby of the building. When an employee tries to enter the building, he/she presses the "opening button", in which case he/she is identified and the access permit is checked. If the employee's access permit to the building is valid, the back-end system 17 sends an opening command to the automatic door for letting the employee into the entrance, lobby F1. In the same connection, the back-end system sends a destination call to the elevator group 10 for collecting the employee from the entrance lobby and for taking him/her to floor F9.

In the following example a customer arrives at a hotel, in which he/she has reserved a room. At the hotel reception desk an identifier device 17 is handed over to him/her, in the service profile of which identifier device reservation data, such as e.g. the floor on which the room is situated, the start time and stop time of the reservation, et cetera, is recorded. The customer moves from the reception desk to the elevators and orders an elevator by pressing/touching a pushbutton 21 of the call panel 11*d*. The customer is identified, in which case the system generates a destination call to the floor on which the room reserved for him/her is located. After the elevator car has arrived and the customer has moved into it, he/she will discover that a call to the aforementioned floor is ready in the car command panel 11*b*. If this is not the case (e.g. the customer went into a wrong elevator car), the customer can give the necessary call from the car command panel of the elevator car, in connection with which he/she is also identified and it is checked that the access permit to the floor according to the call is valid. When the elevator car arrives, or is arriving, at the destination floor of the customer, he/she is given guidance information with a guidance sign (not presented in FIG. 1) in the elevator car about where the room reserved for him/her is situated. After the customer has arrived at the door of the room, he/she grasps the door handle, which is connected to a reader device 22. The reader device reads the data of the identifier device in the pocket of the customer and transmits it to the back-end system, which checks whether the customer has an access right to the room in question. If he/she has, the back-end system sends an open command to the electric lock of the door for letting the customer into the room. By means of his/her identifier device the customer can also use special services, which are intended only for hotel customers. He/she can, for example, travel to the floor on which the gym of the hotel is situated, be allowed to use the internet services of the hotel, etc. Special services can also be chargeable, which services are charged to the customer on the basis of the number of usage times or the usage period of the special services. In this embodiment a certain number of usage times of the gym, i.e. the set usage limit, is "loaded" in advance into the service profile of the customer. The opening pushbutton of the door of the gym is connected to a system according to the invention. Each time the customer goes into the gym, the number of visit times is increased by one until the number reaches the set usage limit, after which the customer no longer has access to the gym. After the room reservation of the customer expires, he/she returns his/her identifier device to the reception desk, where it can be reconfigured and given to the next customer to use.

Although the invention is described above using elevator systems as examples, it is obvious to the person skilled in the art that different embodiments of the invention are not only limited to the examples described above, but that they may be varied within the scope of the claims presented below. Thus, for example, an individual service request can require the consecutive use of a number of pushbuttons, as is the case in connection with the type of destination call panels (11*a*) in which the destination floor is given with a so-called "decade keypad".

The invention claimed is:

1. A method for providing service requests to a conveyance system of a building, the conveyance system including at least one user interface having at least one service request pushbutton for providing the service requests to the conveyance system, the method comprising:

providing an identifier device to a passenger, the identifier device storing identifier device data for determining a service profile of the identifier device;

reading the identifier device data stored in the identifier device when the passenger presses or touches the service request pushbutton;

determining the service profile of the identifier device based on the identifier device data read from the identifier device; and activating one or more service requests connected to the service request pushbutton based on the service profile of the identifier device.

2. The method according to claim 1, wherein a body of the passenger functions at least partly as a transmission path of the identifier device data when reading the identifier device data stored in the identifier device.

3. The method according to claim 1, wherein before activating the one or more service requests, the method further includes, checking an execution right of the passenger for the one or more service requests based on the service profile of the identifier device.

4. The method according to claim 1, wherein at least one of a user interface and a service connected to a service request to be activated is personified based on the service profile of the identifier device.

5. The method according to claim 1, further comprising:

recording usage data about one or more special services used by the passenger based on the one or more service requests.

6. The method according to claim 5, further comprising:

setting a usage limit for the one or more special services; and preventing use of the one or more special services if the usage limit is exceeded.

7. A system to provide service requests to a conveyance system of a building, the conveyance system including at least one user interface having at least one service request pushbutton to provide the service requests to the conveyance system, the system comprising:

at least one identifier device to be provided to a passenger of the conveyance system;

a reader device connected to the service request pushbutton, the reader device being configured to read identifier device data stored in the identifier device when the passenger presses or touches the service request pushbutton; and a back-end system configured to receive the identifier device data, determine a service profile of the identifier device based on the identifier device data, and activate one or more service requests connected to the service request pushbutton based on the service profile.

8. The system according to claim 7, wherein a body of the passenger functions at least partly as a transmission path of the identifier device data when the identifier device data is transferred between the identifier device and the reader device.

9. The system according to claim 7, wherein the back-end system is further configured to record, in connection with the service profile of the identifier device, usage data about special services used by the passenger based on the one or more service requests.

10. The system according to claim 9, wherein the back-end system is further configured to prevent the use of one or more of the special services if a usage limit is exceeded.

11. The system according to claim 7, wherein the identifier device comprises:

a memory configured to store at least one of identifier code of the identifier device and at least a part of the identifier device data for the identifier device.

12. The system according to claim 7, wherein the user interface comprises:

at least one contact surface associated with the service request pushbutton, the at least one contact surface being connected to the reader device.

13. The system according to claim 7, wherein the user interface is a touch-sensitive display.

14. The system according to claim 7, wherein the service request pushbutton is a mechanical pushbutton.

15. The system according to claim 7, wherein the back-end system is configured to personify at least one of a user interface and a service connected to a service request based on the service profile of the identifier device.

* * * * *